US007307377B2

(12) United States Patent
Tatsumi et al.

(10) Patent No.: US 7,307,377 B2
(45) Date of Patent: Dec. 11, 2007

(54) ELECTRON EMITTING DEVICE WITH PROJECTION COMPRISING BASE PORTION AND ELECTRON EMISSION PORTION

(75) Inventors: Natsuo Tatsumi, Itami (JP); Akihiko Namba, Itami (JP); Yoshiki Nishibayashi, Itami (JP); Takahiro Imai, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 252 days.

(21) Appl. No.: 10/952,477

(22) Filed: Sep. 29, 2004

(65) Prior Publication Data

US 2005/0133735 A1 Jun. 23, 2005

(30) Foreign Application Priority Data

Sep. 30, 2003 (JP) ..... P2003-341854

(51) Int. Cl.
*H01J 1/02* (2006.01)

(52) U.S. Cl. ..... 313/309; 313/495; 313/310; 313/336; 313/351

(58) Field of Classification Search ..... 313/495, 313/309, 310, 351, 336, 346 R
See application file for complete search history.

(56) References Cited

U.S. PATENT DOCUMENTS 3,581,151 A 5/1971 Boyle et al.
5,199,918 A 4/1993 Kumar
5,410,166 A 4/1995 Kennel
5,656,883 A * 8/1997 Christensen ..... 313/310
5,679,895 A * 10/1997 von Windheim ..... 73/514.25
5,844,252 A 12/1998 Shiomi et al.
6,132,278 A 10/2000 Kang et al.
6,465,941 B1 * 10/2002 Kubota et al. ..... 313/309
6,762,543 B1 * 7/2004 Kang et al. ..... 313/311
6,876,136 B2 * 4/2005 Nishibayashi et al. ..... 313/309

FOREIGN PATENT DOCUMENTS

EP 0 645 793 A2 3/1995
EP 1 184 885 A1 3/2002

(Continued)

OTHER PUBLICATIONS

Geis, M. W., et al., "Diamond emitters fabrication and theory", J.Vac. Sci. Technol. B 14(3), May/Jun. 1998.

(Continued)

*Primary Examiner*—Nimeshkumar D. Patel
*Assistant Examiner*—Kevin Quarterman
(74) *Attorney, Agent, or Firm*—McDermott Will & Emery LLP

(57) ABSTRACT

The present invention relates to an electron emitting device having a structure for efficiently emitting electrons. The electron emitting device has a substrate comprised of an n-type diamond, and a pointed projection provided on the substrate. The projection comprises a base provided on the substrate side, and an electron emission portion provided on the base and emitting electrons from the tip thereof. The base is comprised of an n-type diamond. The electron emission portion is comprised of a p-type diamond. The length from the tip of the projection (electron emission portion) to the interface between the base and the electron emission portion is preferably 100 nm or less.

4 Claims, 11 Drawing Sheets

FOREIGN PATENT DOCUMENTS

| | | | |
|---|---|---|---|
| JP | 4-67528 | | 3/1992 |
| JP | 5-13342 | A | 1/1993 |
| JP | 8-321256 | A | 12/1996 |
| JP | 9-35622 | | 2/1997 |
| JP | 9-45215 | A | 2/1997 |
| JP | 9-320450 | A | 12/1997 |
| JP | 2728226 | | 12/1997 |
| JP | 10-50205 | A | 2/1998 |
| JP | 10-241549 | A | 9/1998 |
| JP | 11-15445 | | 6/1999 |
| JP | 11-195372 | A | 7/1999 |
| JP | 2000-260300 | | 9/2000 |
| JP | 2002-75171 | A | 3/2002 |

OTHER PUBLICATIONS

European Search Report for Corresponding European Application No. 04 78 8202, dated Feb. 6, 2007.

International Preliminary Examination Report issued in corresponding International Application No. PCT/JP2004/014106.

* cited by examiner

ELECTRON EMITTING DEVICE WITH PROJECTION COMPRISING BASE PORTION AND ELECTRON EMISSION PORTION

BACKGROUND OF THE INVENTION

1. Field of the Invention

The present invention relates to an electron emitting device extensively applicable to such apparatus as high-frequency amplifiers, microwave oscillators, light emitting devices, and electron beam lithography apparatus.

2. Related Background Art

The conventional electron emitting devices (electron sources) having been used heretofore include thermionic emission sources using a tungsten filament, cold cathodes using lanthanum hexaboride, thermal-field emission cathodes using zirconia-coated tungsten, and so on. Among materials applied to these electron emitting devices, diamond is drawing attention in recent years because of possession of negative electron affinity. Examples of the known electron emitting devices of this type include the electron emitting device in which a metal cathode is coated with diamond, as described in Journal of Vacuum Science and Technology B 14 (1996) 2060 (Document 1), the electron emitting device in which a layer with continuously varying bandgap is formed in a diamond emitter of projecting shape, as described in Japanese Patent Application Laid-Open No. 11-154455 (Document 2), in order to effectively utilize the negative electron affinity of diamond, and the electron emitting device using a pn junction of diamond, as described in Japanese Patent Application Laid-Open No. 4-67528 (Document 3).

SUMMARY OF THE INVENTION

The Inventors investigated the details of the conventional electron emitting devices as described above, and found the following problems.

Namely, the electron emitting device described in above Document 1 has the problem that electrons are not effectively injected into diamond particles in the surface, and electrons existing not in the conduction band of diamond but in the valence band in fact are considered to be emitted by a strong electric field. The electron emitting device described in above Document 2 has the problem that the crystallinity of diamond is poor and even when electrons are injected into the conduction band of diamond, the electrons will lose their energy because of scattering, recombination, and so on. For this reason, electrons can fail to reach the surface of the cathode in the electron emitting device described in above Document 2, and are considered not to effectively contribute to electron emission. Furthermore, the electron emitting device described in above Document 3 requires an electrode to be formed on an electron emission surface, in order to inject electrons into the conduction band of diamond. Therefore, the electron emitting device described in above Document 3 has the problem of complicated structure and the problem of power consumption caused by a bias for driving.

The present invention has been accomplished in order to solve the problems as described above, and an object of the present invention is to provide an electron emitting device having a structure for efficiently emitting electrons.

An electron emitting device according to the present invention comprises a substrate comprised of an n-type diamond, and a projection formed on the substrate. The projection comprises a base comprised of an n-type diamond, and an electron emission portion provided on the base and emitting electrons from a tip thereof. The electron emission portion is comprised of one of a p-type diamond or a non-doped (intrinsic) diamond.

In the configuration as described above, a space charge region formed in an area including an interface between the base and the electron emission portion (a junction interface between the n-type diamond and the p-type diamond or a junction interface between the n-type diamond and the non-doped diamond) is located on the tip side rather than on the root side of the projection. In this case, the electric field readily penetrates the interior of the projection to lower the energy band of the space charge region, so as to establish a low barrier state without need for provision of the electrode as required in the electron emitting device described in above Document 3. This matter means that electrons in the n-type diamond forming the base come to be effectively injected into the conduction band of the diamond forming the electron emission portion. After electrons are injected into the conduction band of the diamond, the electrons rarely lose their energy inside the projection because of scattering or the like, and the electrons adequately come to reach the surface of the electron emission portion. In consequence, the electron emitting device efficiently emits electrons from the tip of the electron emission portion.

The electron emission portion constituting a part of the projection may have a tip layer comprised of a p-type diamond, and an intermediate layer comprised of a non-doped diamond provided between the tip layer and the base. In this configuration, the space charge region, which is formed in the area including the interface (a junction interface between the n-type diamond and the non-doped diamond) between the base and the electron emission portion (the intermediate layer), is located on the tip side rather than in the root region of the projection. In this case, when electrons are emitted from the electron emitting device by an electric field, the electric field also becomes more likely to be exerted on the projection, without need for provision of the electrode as required in the electron emitting device described in above Document 3. In other words, the electric field readily penetrates the interior of the projection to lower the energy band of the space charge region, so as to establish a low barrier state. This matter means that electrons in the n-type diamond forming the base come to be effectively injected into the conduction band of the diamond forming the electron emission portion. After electrons are injected into the conduction band of the diamond, the electrons rarely lose their energy inside the projection because of scattering or the like, and adequately come to reach the surface of the electron emission portion. Furthermore, since the intermediate layer of the non-doped diamond is provided, it is feasible to decrease crystal defects or the like in the interface and thus to prevent loss of energy during passage of electrons through the interface. As a result, the electron emitting device efficiently emits electrons from the tip of the electron emission portion.

In the electron emitting device according to the present invention, a height of the electron emission portion, which is defined by a distance from the tip of the projection to the interface between the base and the electron emission portion, is preferably 100 nm or less. In this case, the space charge region formed in the area including the junction interface between the different kinds of diamonds is located in the vicinity of the tip of the projection. For this reason, when electrons are emitted from the electron emitting device by an electric field, the electric field adequately penetrates the interior of the projection to effectively lower the energy band of the space charge region. As a result, electrons are efficiently emitted from the tip of the electron emission portion. This distance permits the electrons injected into the base of the projection to reach the tip of the electron emitting device without loss of energy due to scattering or the like, whereby the electrons can be emitted more effectively.

In the electron emitting device according to the present invention, the height of the electron emission portion, defined by the distance from the tip of the projection to the interface between the base and the electron emission portion, is preferably not more than a width of the space charge region formed in the area including the interface between the base and the electron emission portion. In this case, since the distance from the tip of the projection to the interface between the base and the electron emission portion becomes sufficiently short, the space charge region is located in the vicinity of the tip of the projection. Therefore, when electrons are emitted from the electron emitting device by an electric field, the electric field adequately penetrates the interior of the projection to effectively lower the energy band of the space charge region. As a result, the electron emitting device further efficiently emits electrons from the tip of the electron emission portion.

In the electron emitting device according to the present invention, the interface between the base and the electron emission portion or the interface between the base and the intermediate layer is preferably exposed in a vacuum space. This configuration permits the electric field to effectively intrude into the interface as well, whereby the energy band of the space charge region is lowered, so as to increase the electron emission efficiency.

Furthermore, the electron emitting device according to the present invention preferably further comprises an electroconductive material covering at least a side face of the base. In this configuration, when a voltage is applied between the electron emitting device and an electrode such as an anode, electrons are sufficiently supplied into the n-type diamond forming the base. Since the electroconductive material part wholly becomes equipotential, it is feasible to increase the intensity of the electric field penetrating the interior of the projection in an end region of the electroconductive material at the tip of the projection.

In the electron emitting device according to the present invention, a distance (a distance along a height direction of the electron emission portion), from an end of the electroconductive material to the interface between the base and the electron emission portion or to the interface between the base and the intermediate layer, is set in a certain range. Here, when R represents a maximum size of the projection at the interface (in the case where the projection is conical, the maximum size is a diameter of the interface) and L a minimum distance along the height direction of the electron emission portion from the interface to the end of the electroconductive material, the electron emitting device preferably satisfies a condition of $L<R$ or a condition of $L<1000$ nm. When the condition of $L<R$ is satisfied, a precipitous electric field is exerted on the depletion region at the interface. When the condition of $L<1000$ nm is satisfied, the distance L becomes shorter than the mean free path of electrons under a high electric field, and it is thus feasible to suppress carrier loss due to recombination and to efficiently inject electrons into the electron emission portion.

When $L>R$ on the other hand, the electric field will gently penetrate the entire projection, so as to fail to efficiently lower the band and to cause an extraneous resistance, thereby adversely affecting the electron emission-current characteristics. In addition, when $L>1000$ nm, electrons will lose their energy in the p-type or non-doped electron emission portion because of interaction with the lattice or the like. In this case, electrons cannot exist in the conduction band, and it thus becomes infeasible to effectively utilize the property of negative electronegativity of the outermost surface.

In the electron emitting device according to the present invention, the surface of the electron emission portion is preferably hydrogen-terminated. In this case, the surface of the electron emission portion is kept in the negative electron affinity, so that the electron emission characteristics become stabilized over long periods.

Furthermore, the electron emitting device according to the present invention preferably further comprises a gate electrode for controlling emission of electrons from the tip of the electron emission portion. This gate electrode is placed through an insulator or a vacuum space on the substrate in a state in which the gate electrode is spaced by a predetermined distance from the electron emission portion and surrounds the electron emission portion.

Each of embodiments of the present invention can be further fully understood in view of the detailed description and accompanying drawings which will follow. It is noted that these embodiments will be presented merely for illustrative purposes, but are not to be construed in a way of limiting the present invention.

The range of further application of the present invention will become apparent from the following detailed description. It is, however, apparent that the detailed description and specific examples will describe only the preferred embodiments of the present invention and be presented for illustrative purposes only, and that various modifications and improvements falling within the spirit and scope of the present invention are obvious to those skilled in the art in view of the detailed description.

DETAILED DESCRIPTION OF THE PREFERRED EMBODIMENTS

Each of embodiments of the electron emitting device according to the present invention will be described below in detail with reference to FIGS. 1 to 11. The same portions and the same elements will be denoted by the same reference symbols throughout the description of the drawings, without redundant description.

Figure 1:
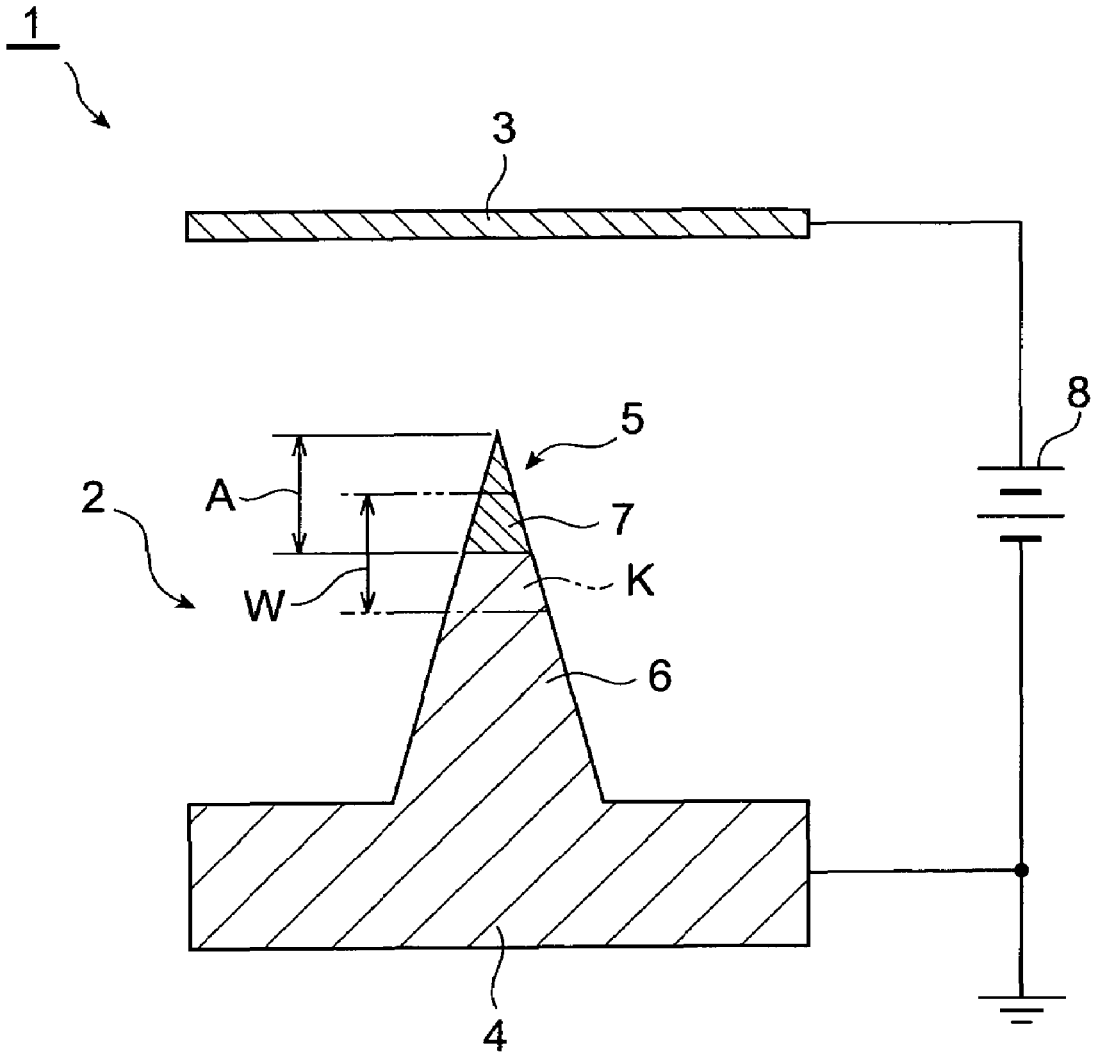
FIG. 1 is a sectional view showing a configuration of an electron beam source having a first embodiment of the electron emitting device according to the present invention.

FIG. 1 is a sectional view showing a configuration of an electron beam source having the first embodiment of the electron emitting device according to the present invention. In this FIG. 1, the electron beam source 1 has an electron emitting device 2 made of diamonds, and a positive electrode (anode) 3 placed opposite to this electron emitting device 2. The electron emitting device 2 and anode 3 are installed in a vacuum chamber.

The electron emitting device 2 has a substrate 4 made of an n-type diamond, and a plurality of projections 5 (only one of which is shown in FIG. 1) formed on the substrate 4. The projections 5 have a pointed shape such as a conical shape or a quadrangular pyramid.

The projection 5 comprises a base 6 provided on the substrate 4 side, and an electron emission portion 7 provided on the base 6 and emitting electrons from its tip. The base 6 is made of an n-type diamond in similar to the substrate 4. The electron emission portion 7 is made of a p-type diamond.

The n-type diamond is a diamond obtained by doping a non-doped diamond containing no impurity, with one element selected from nitrogen, phosphorus, sulfur, and lithium, or with two or more elements selected therefrom, or with one element selected therefrom, together with boron as an impurity. The p-type diamond is a diamond obtained by doping a non-doped diamond with such an impurity as boron.

In order to achieve excellent electron emission characteristics, the p-type diamond forming the electron emission portion 7 is preferably a diamond with good crystallinity. The amount of defects is preferably as small as possible at the interface between the n-type diamond forming the base 6 and the p-type diamond forming the electron emission portion 7.

Figure 2:
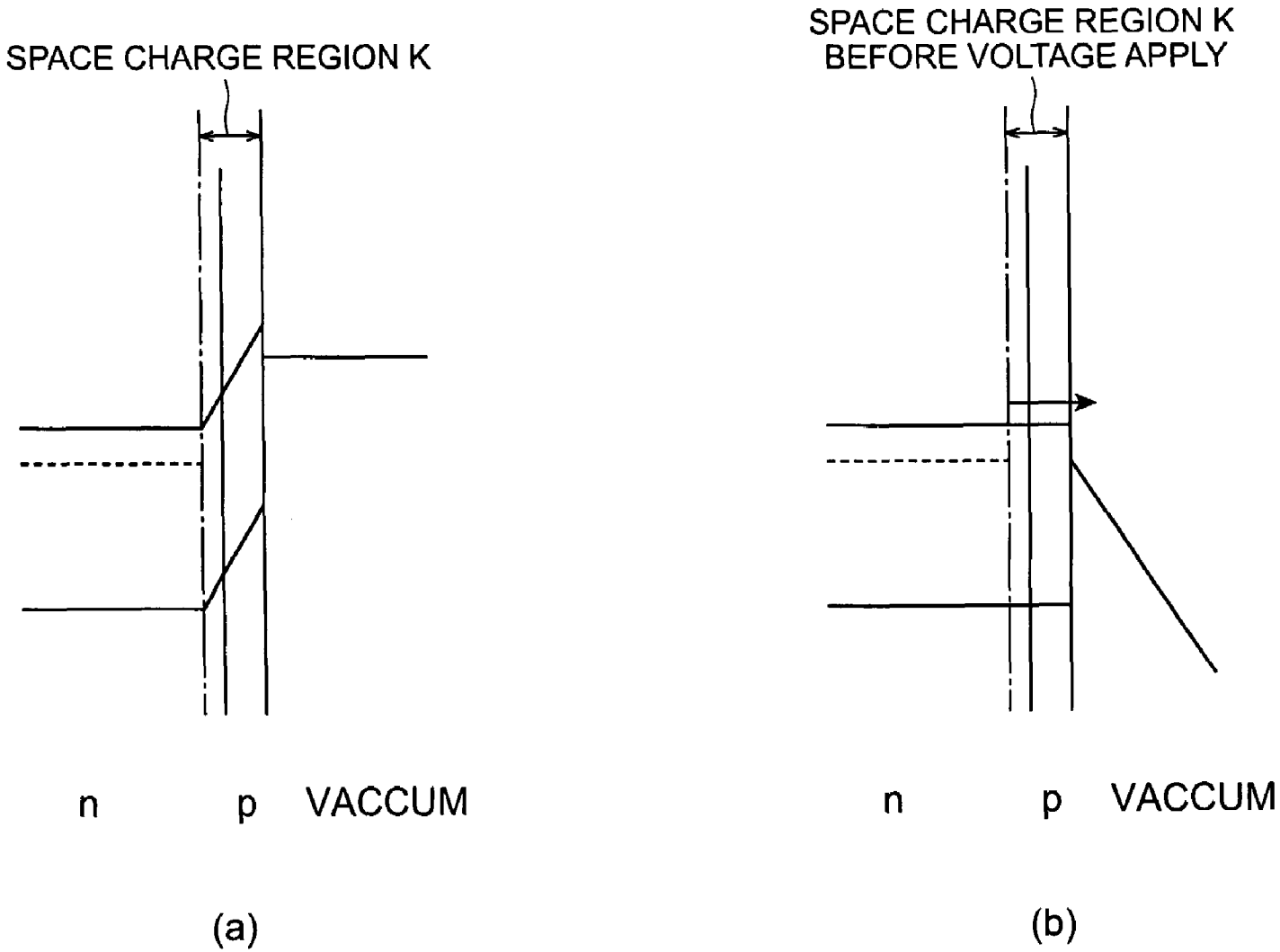
FIG. 2 is energy bands of diamonds forming a projection of the electron emitting device in FIG. 1.

As the projection 5 comprises the base 6 and the electron emission portion 7 as described above, a pn junction is created by the n-type diamond and the p-type diamond inside the projection 5. In this case, a depletion layer (space charge region) K with reduced carriers is created, as shown in FIG. 2, in the area including the interface between the base 6 and the electron emission portion 7 (the junction interface between the n-type diamond and the p-type diamond). The area (a) in FIG. 2 shows the energy bands of the diamonds forming the projection 5 before application of a voltage, and the area (b) in FIG. 2 shows the energy bands of the diamonds during application of a voltage.

Figure 3:
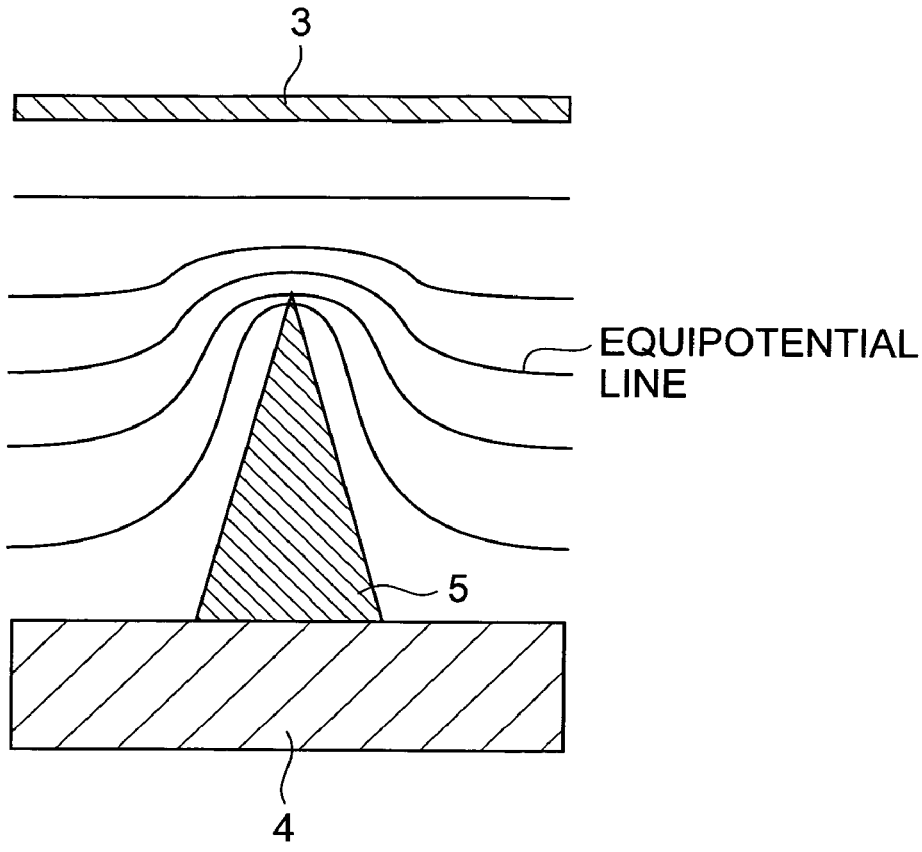
FIG. 3 is a sectional view showing a configuration of an electron beam source having an electron emitting device in which an entire projection on a substrate is made of a p-type diamond, together with an electric field distribution established between the electron emitting device and an anode.

Since the projection 5 herein comprises the base 6 of the n-type diamond and the electron emission portion 7 of the p-type diamond, the p-type region in the diamonds forming the projection 5 is smaller than that, for example, in a case where the entire projection 5 is made of the p-type diamond as shown in FIG. 3. Therefore, the energy band of the p-type region is not flat but in a continuously bent state from the depletion layer K, as shown in the area (a) of FIG. 2.

The surface of the projection 5 is hydrogen-terminated. In this case, only the surface of the electron emission portion 7 may be hydrogen-terminated, or the both surfaces of the base 6 and the electron emission portion 7 may be hydrogen-terminated. This configuration maintains the surface of the electron emission portion 7 in the negative electron affinity, so that the electron emission characteristics become stabilized over long periods.

A power supply 8 for applying to the anode 3 a positive voltage with respect to the electron emitting device 2 being a cathode, is connected between the substrate 4 of the electron emitting device 2 of the above configuration and the anode 3. When a predetermined voltage is applied to the anode 3 by the power supply 8, an electric field is established between the electron emitting device 2 and the anode 3.

At this time, since the projection 5 of the electron emitting device 2 is acutely pointed, a strong electric field is applied to the tip part of the projection 5, but not to the base end part of the projection 5. Since few carriers exist in the depletion layer K present inside the projection 5, the electric field is likely to be exerted on the depletion layer K, so that the energy band of the depletion layer K is bent by the electric field.

Figure 4:
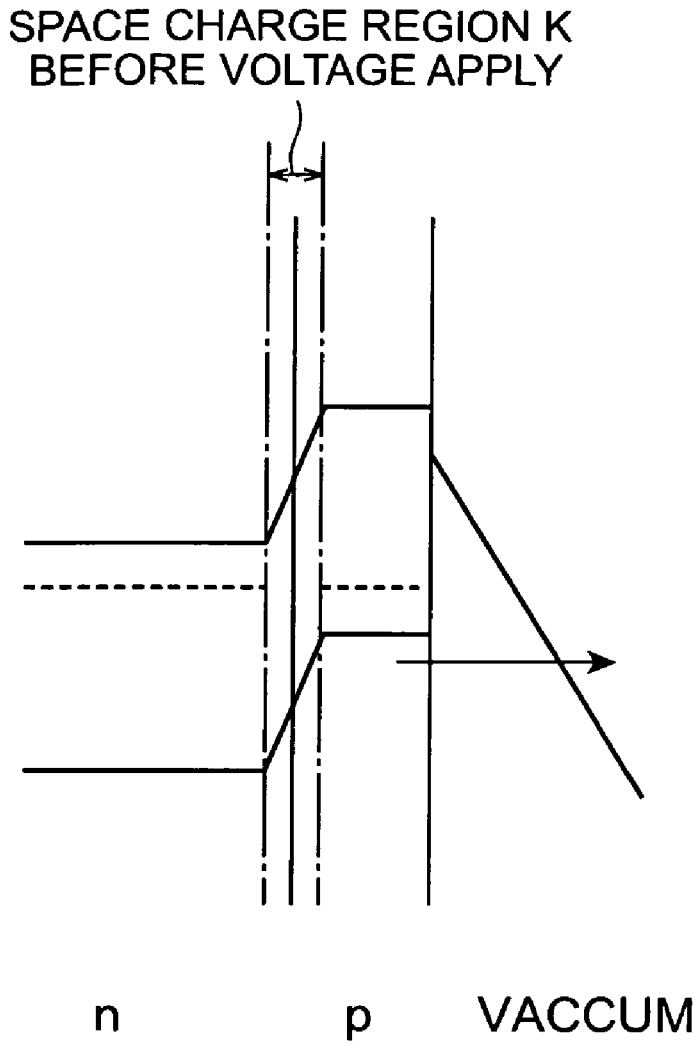
FIG. 4 is energy bands (during application of a voltage) of the diamonds forming the projection of the electron emitting device shown in FIG. 3.

Incidentally, in the case where the entire projection 5 provided on the n-type diamond substrate 4 is made of the p-type diamond, as shown in FIG. 3, the depletion layer in the diamond is present in the root part of the projection 5. For this reason, when an electric field is generated between the substrate 4 and the anode 3, the electric field is shielded by carriers existing in the p-type diamond forming the projection 5, so that the electric field is unlikely to be applied to the interior of the projection 5. As a result, it becomes difficult for the electric field to bend the energy band of the depletion layer, as shown in FIG. 4, so that electrons cannot be effectively emitted into the vacuum.

Figure 5:
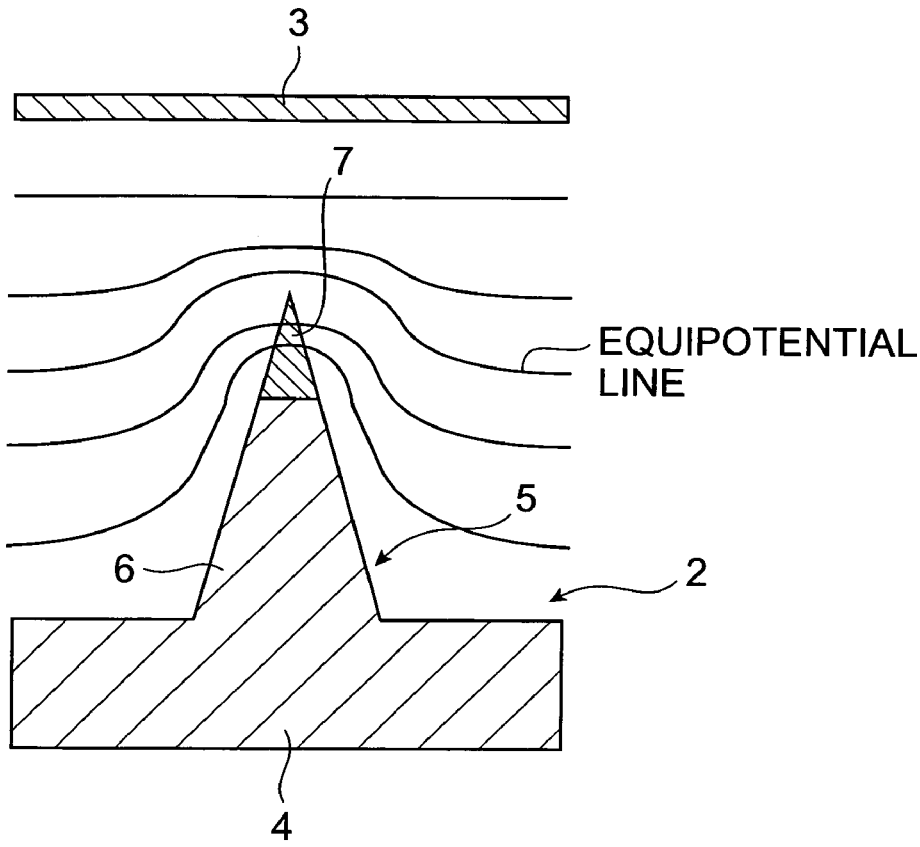
FIG. 5 is an illustration showing an electric field distribution established between the electron emitting device and the anode in FIG. 1.

In contrast to it, since the electron emitting device 1 of the foregoing first embodiment has the small region of the p-type diamond forming the tip side of the projection 5, the depletion layer K in the diamonds is located on the tip side rather than on the root side of the projection 5. Namely, as shown in FIG. 5, the electric field established between the electron emitting device 2 and the anode 3 readily penetrates the interior of the projection 5. This means that the electric field effectively lowers the energy band of the depletion layer K, as shown in the area (b) of FIG. 2, so as to establish a low barrier state. As a result, electrons in the n-type diamond forming the base 6 of the projection 5 come to be adequately injected into the conduction band of the p-type diamond forming the electron emission portion 7.

When the electric field is still maintained between the electron emitting device 2 and the anode 3 even after the injection of electrons into the conduction band of the p-type diamond, the electric field will readily penetrate the interior of the projection 5 to lower the energy band of the depletion layer K, as described above, so as to maintain the low barrier state. For this reason, electrons rarely lose their energy due to scattering, recombination, or the like in the projection 5, and electrons adequately reach the surface of the electron emission portion 7 having the negative electron affinity. In that state the electrons are then emitted from the tip of the electron emission portion 7 into vacuum.

In this configuration, the height A of the electron emission portion 7, which is defined by a distance from the tip of the projection 5 (electron emission portion 7) to the interface between the base 6 and the electron emission portion 7, is preferably 100 nm or less. In this case, the depletion layer K in the diamonds forming the projection 5 is located in the vicinity of the tip of projection 5. Therefore, even when the voltage applied to the anode 3 is relatively low, the electric field can readily penetrate the interior of the projection 5 to lower the energy band of the depletion layer K. As a result, electrons can be emitted from the tip of the electron emission portion 7 by the low drive voltage.

The width W of the depletion layer K in the diamonds differs depending upon impurity concentrations; for example, in a case where the boron concentration in the p-type diamond doped with boron is $3\times10^{18}cm^{-3}$ in order to achieve good crystallinity and electric conductivity; the width W of the depletion layer K is about 50 nm. Therefore, the distance A from the tip of the projection 5 to the interface between the base 6 and the electron emission portion 7 (the height of the electron emission portion 7) may be not more than the width W of the depletion layer K. The width W of the depletion layer K herein is a width in a state before application of the voltage.

Furthermore, when the distance A from the tip of the projection 5 to the interface between the base 6 and the electron emission portion 7 is 10 nm or less, electrons present inside the projection 5 move to the surface of the electron emission portion 7 with little loss of their energy. Therefore, electrons become likely to be emitted from the electron emission portion 7.

In the case of the electron emitting device of the first embodiment as described above, electrons in the n-type diamond forming the base 6 of the projection 5 are adequately injected into the conduction band of the p-type diamond forming the electron emission portion 7 and the electrons injected into the conduction band of the p-type diamond adequately reach the surface of the electron emission portion 7. As a result, the electron emitting device is able to efficiently emit electrons.

Since the electron emitting device has the configuration wherein the projections 5 are provided on the substrate 4 and wherein electrons are emitted by the electric field concentrated at the projections 5, there is no need for providing the both n-type diamond layer and p-type diamond layer with an electrode for a bias. For this reason, there is no need for continuously applying a voltage between the pn junction in order to continuously bend the energy band of the depletion layer K in the diamonds, which enables power saving in operation.

Figure 6:
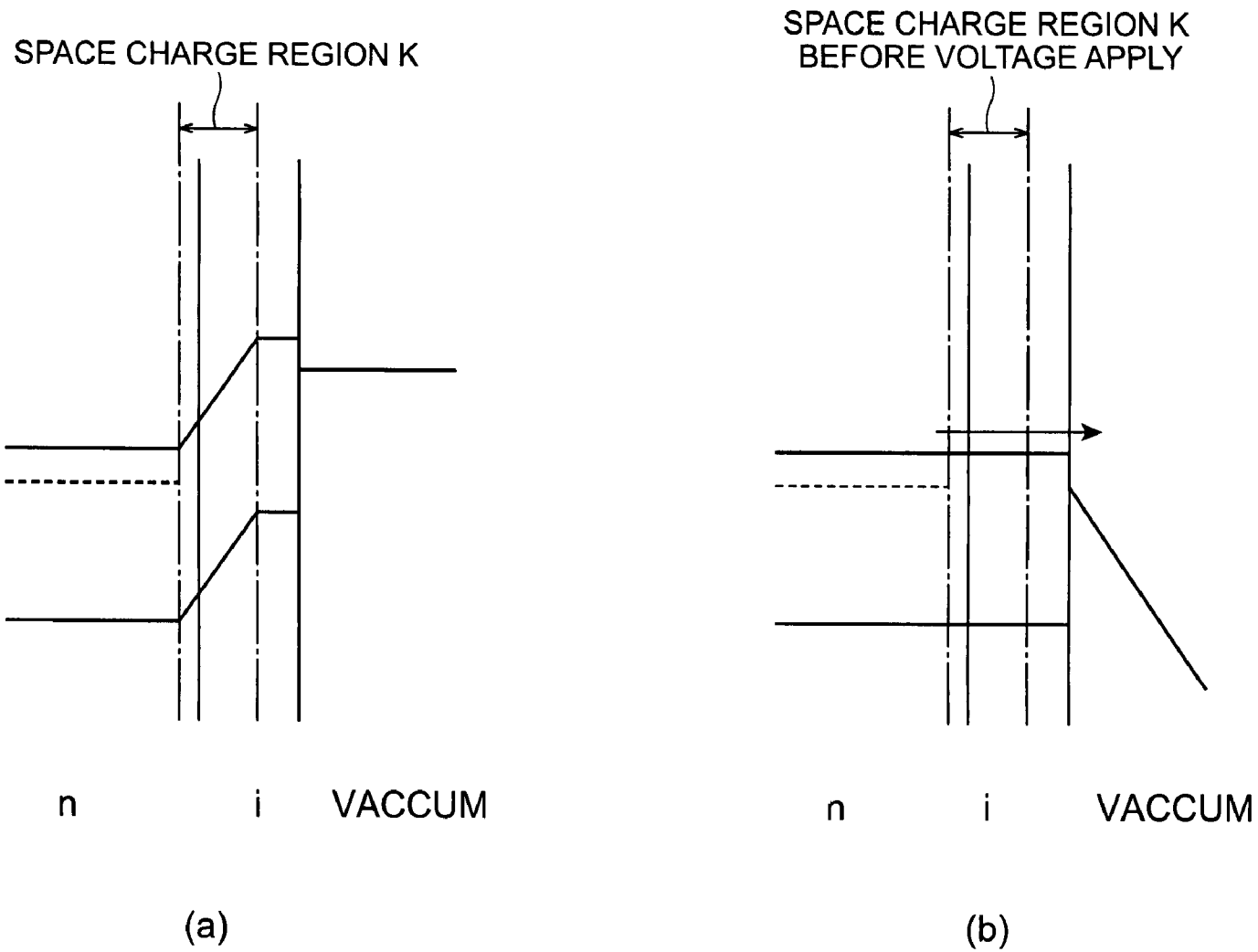
FIG. 6 is energy bands of diamonds in a case where the electron emission portion in FIG. 1 is made of a non-doped diamond.

In the first embodiment described above, the electron emission portion 7 of the projection 5 was made of the p-type diamond, but it may also be made of a non-doped diamond (i-type diamond). In this case, when an electric field is generated between the electron emitting device 2 and the anode 3, the electric field readily penetrates the interior of the diamonds forming the projection 5, to lower the energy band of the space charge region K formed in the area including the junction interface between the n-type diamond and the i-type diamond, as shown in FIG. 6. This permits the electron emitting device 2 to efficiently emit electrons. The area (a) in FIG. 6 shows the energy band of the non-doped diamond forming the electron emission portion 7 before application of the voltage, and the area (b) in FIG. 6 shows the energy band of the non-doped diamond during application of the voltage.

Figure 7:
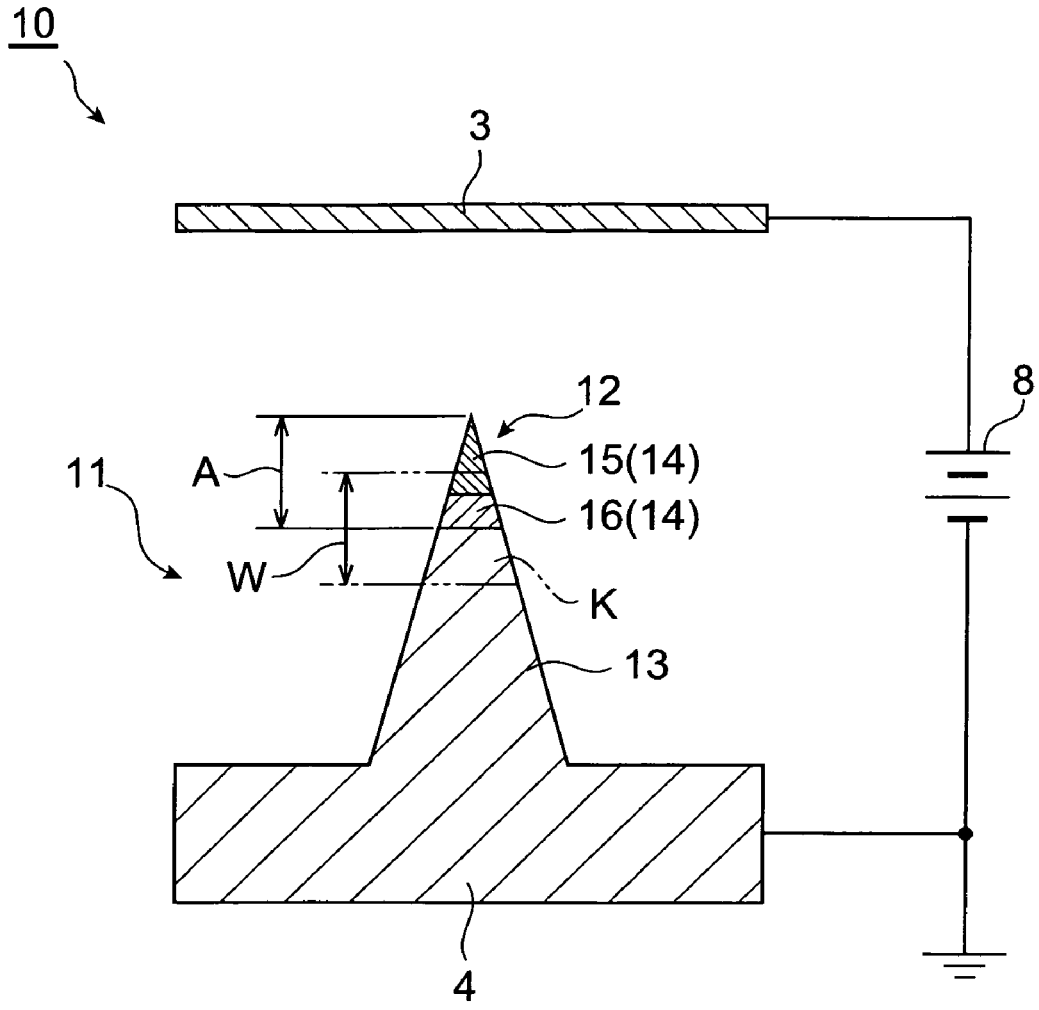
FIG. 7 is a sectional view showing a configuration of an electron beam source having a second embodiment of the electron emitting device according to the present invention.

FIG. 7 is a sectional view showing a configuration of an electron beam source having the second embodiment of the electron emitting device according to the present invention. In this FIG. 7, the electron beam source 10 has the electron emitting device 11 of the second embodiment. This electron emitting device 11 of the second embodiment has pointed projection 12 formed on the substrate 4. The projection 12 comprises a base 13 of an n-type diamond, and an electron emission portion 14 provided on the base 13 and emitting electrons from its tip.

The electron emission portion 14 comprises a tip layer 15 of a p-type diamond, and an intermediate layer 16 provided between the tip layer 15 and the base 13 and made of a non-doped diamond (i-type diamond). Since the intermediate layer 16 of the non-doped diamond is provided between the tip layer 15 and the base 13 as described above, it is feasible thereby to decrease the number of crystal defects or the like in the interface and to prevent loss of energy during passage of electrons through the interface.

The distance A from the tip of the projection 12 (electron emission portion 14) to the interface between the base 13 and the electron emission portion 14 (the height of the electron emission portion 14) is preferably 100 nm or less and may be not more than the width W of the space charge region K formed in the area including the junction interfaces between the n-type diamond and the i-type diamond and between the i-type diamond and the p-type diamond.

Figure 8:
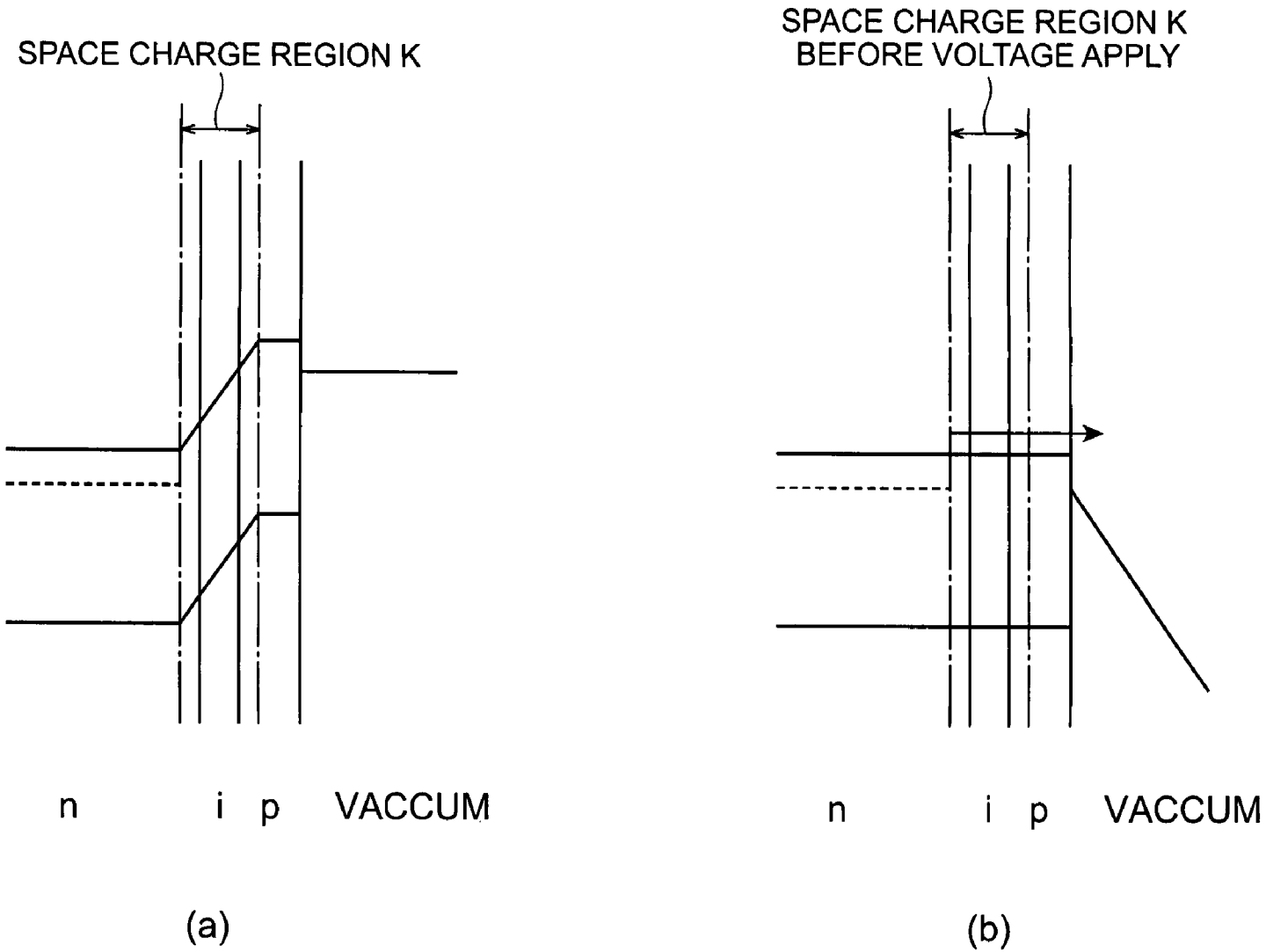
FIG. 8 is energy bands of diamonds forming the projection of the electron emitting device in FIG. 7.

In the electron beam source 10 of this configuration, when a predetermined voltage is applied to the anode 3 by the power supply 8, an electric field is generated between the electron emitting device 11 and the anode 3 and the electric field readily penetrates the interior of the diamonds forming the projection 12. Then the electric field lowers the energy band of the space charge region K, as shown in FIG. 8, to establish a low barrier state and in that state electrons are efficiently emitted from the tip of the projection 12 into vacuum. The area (a) in FIG. 8 shows the energy bands of the diamonds forming the electron emission portion 14 before application of the voltage, and the area (b) in FIG. 8 shows the energy bands of the diamonds during application of the voltage.

Figure 9:
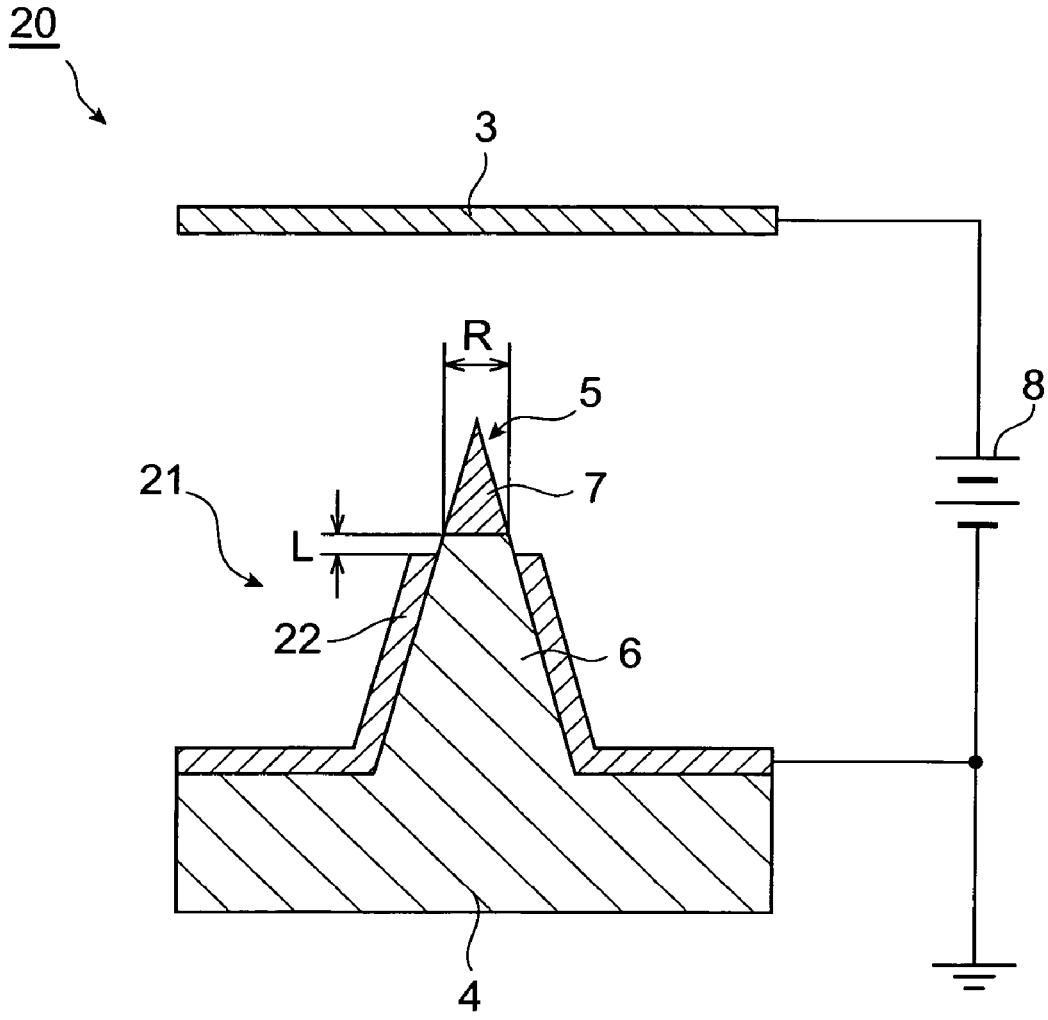
FIG. 9 is a sectional view showing a configuration of an electron beam source having a third embodiment of the electron emitting device according to the present invention.

FIG. 9 is a sectional view showing a configuration of an electron beam source having the third embodiment of the electron emitting device according to the present invention. In this FIG. 9 the electron beam source 20 has the electron emitting device 21 according to the third embodiment. The electron emitting device 21 according to the third embodiment has the substrate 4 and projection 5 of the same structure as those in the electron emitting device 1 according to the first embodiment described above. The electron emitting device 21 according to the third embodiment is, however, different from the first embodiment in that the surface of the substrate 4 and the side face of the base 6 in the projection 5 are covered by an electrode part 22 of an electroconductive material such as Ti.

Here the electrode part 22 of the electroconductive material preferably forms an ohmic contact with the surface of the substrate 4 and with the side face of the base 6 of the projection 5. For that, a thermal treatment may be carried out after evaporation of Ti or the like to improve the ohmic contact, or a material such as graphite may be used for the electrode. The electrode part 22 covering the side face of the base 6 extends from the root of the projection 5 up to the area on the substrate 4 side with respect to the interface between the base 6 and the electron emission portion 7. The power supply 8 for applying the voltage to the anode 3 is connected between the electrode part 22 and the anode 3.

Since the above electrode part 22 is provided, when an electric field is generated by application of the predetermined voltage to the anode 3 by the power supply 8, a sufficient amount of electrons of carriers are supplied into the n-type diamond forming the base 6 of the projection 5. Since the electrode part 22 is wholly equipotential, the intensity of the electric field penetrating the interior of the projection 5 can be increased in the edge region of the electrode part 22.

Furthermore, where the electroconductive material is metal, the energy band becomes completely flat. On the other hand, the electric field on the projection 5 of the diamonds becomes stronger toward the tip of the projection 5 as described previously. When the electrode part 22 is provided, it becomes feasible to make the energy band completely flat up to the predetermined position on the substrate 4 side with respect to the interface between the base 6 and the electron emission portion 7 and to strongly suddenly bend the energy band at the predetermined position.

Here, the distance L between the edge of the electroconductive material and the interface (the distance along the height direction of the electron emission portion 7) preferably satisfies the condition of L<R, when compared with the diameter R of the projection 5 at the interface. In this third embodiment, the diameter of the interface is 300 nm and the distance L 200 nm.

Figure 10:
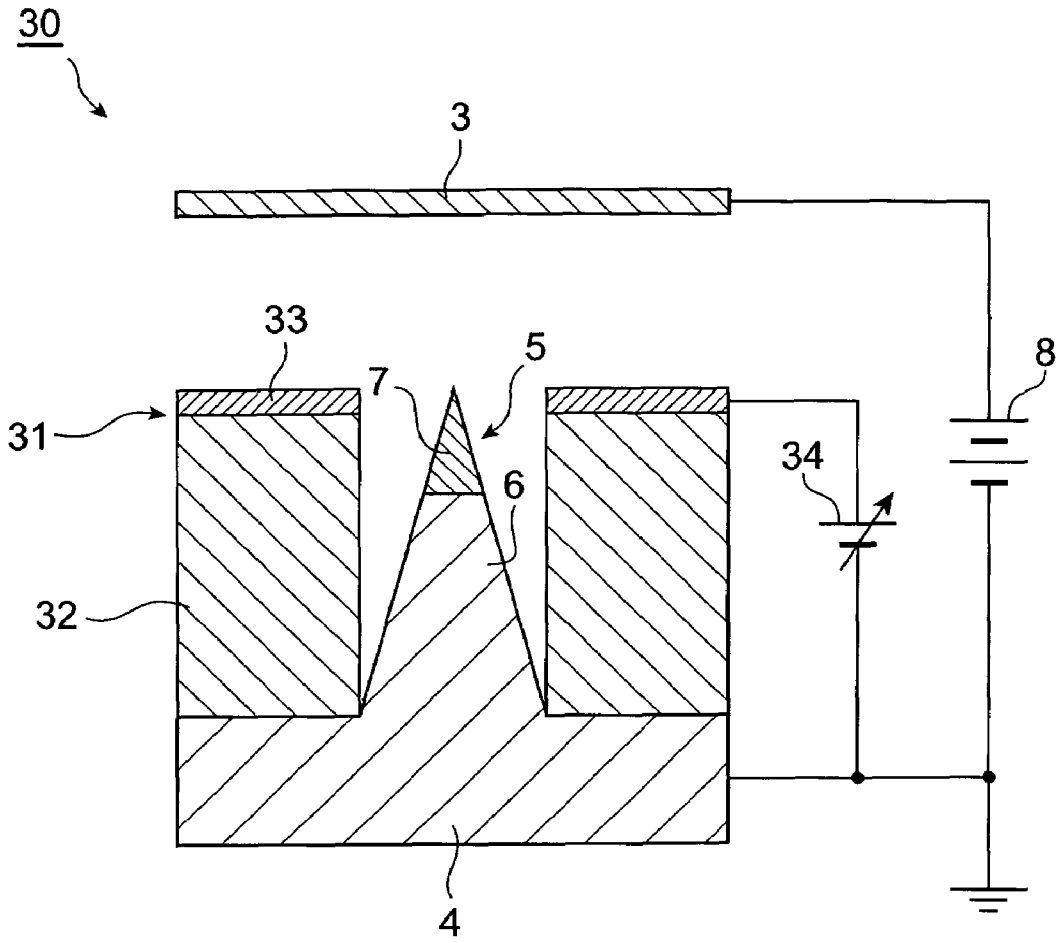
FIG. 10 is a sectional view showing a configuration of an electron beam source having a fourth embodiment of the electron emitting device according to the present invention.

FIG. 10 is a sectional view showing a configuration of an electron beam source having the fourth embodiment of the electron emitting device according to the present invention. In this FIG. 10 the electron beam source 30 has the electron emitting device 31 according to the fourth embodiment. The electron emitting device 31 according to the fourth embodiment also has the substrate 4 and projection 5 of the same structure as those in the electron emitting device 1 according to the first embodiment. The electron emitting device 31 according to the fourth embodiment is, however, different from the first embodiment in that it is provided with a gate electrode 33 through an insulating layer 32 on the substrate 4. In this fourth embodiment, a variable power supply 34 for applying a voltage to the gate electrode 33 is connected between the substrate 4 and the gate electrode 33.

In this configuration, the variable power supply 34 controls the voltage to be applied to the gate electrode 33, whereby the emission amount of electrons (electric current of emitted electrons) from the electron emitting device 31 can be readily and finely regulated by a low voltage. In this configuration, the surface of the base 6 of the projection 5 may be covered with an electroconductive material as in the third embodiment described above.

Figure 11:
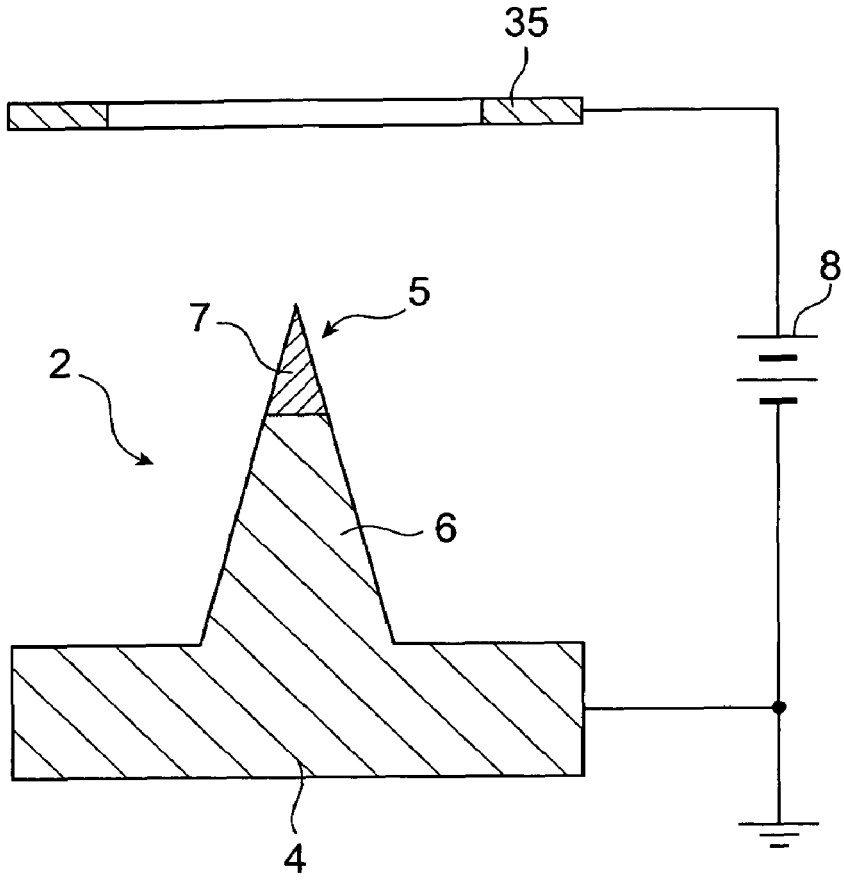
FIG. 11 is a sectional view showing another configuration of an electron beam source having an electron emitting device according to the present invention.

The electron emitting devices according to the present invention are not limited to the above-described embodiments. For example, the electron beam source having the electron emitting device in each embodiment described above used the anode 3 as an electrode for emitting electrons from the electron emitting device, but, where the electron emitting device is applied to an electron gun or the like, it is also possible to adopt a configuration wherein an annular acceleration electrode 35 as shown in FIG. 11 is provided instead of the anode 3. FIG. 11 is a sectional view showing another configuration of an electron beam source to which each embodiment of the electron emitting device according to the present invention can be applied.

Next, a specific configuration of the electron beam source having the electron emitting device according to the third embodiment described above will be described below.

First produced is an electron beam source with an electron emitting device having the structure as shown in FIG. 9. Specifically, an n-type phosphorus-doped diamond is formed on the (111) face of a p-type IIa diamond single crystal synthesized by a high temperature and pressure process, by microwave plasma CVD. The conditions for growth of this phosphorus-doped diamond are the temperature of synthesis of 870° C., the hydrogen/methane gas flow ratio of 0.05%, the methane/phosphine gas flow ratio of 10000 ppm, and the thickness of 10 μm.

Then a p-type boron-doped diamond is formed by microwave plasma CVD with a different dopant gas. The conditions for growth of this boron-doped diamond are the synthesis temperature of 830° C., the hydrogen/methane gas flow ratio of 6.0%, the methane/diborane gas flow ratio of 0.83 ppm, and the thickness of 0.2 μm.

Furthermore, a film of Al is deposited on the previously formed diamond film by sputtering, and this Al film is processed into a dot pattern by photolithography and wet etching. Thereafter, the diamonds are etched by RIE. The diamonds after the etching constitute emitters of projecting shape 5 μm high as shown in FIG. 9. At this time, the thickness of the p-type boron-doped diamond in the projecting tip portions is reduced to 40 nm by etching.

The surface of the phosphorus-doped diamond on the emitter side is further subjected to ion implantation of Ar, and the diamond surface is graphitized. With heating at 300° C., Ti is evaporated on the diamond with the graphitized surface to form an ohmic electrode. An anode electrode (positive electrode) is set at a distance of 100 μm from the emitters.

In the above configuration, a predetermined voltage is applied between the ohmic electrode and the anode electrode to make the electron emitting device emit electrons. At this time, the threshold voltage for a start of electron emission was a low voltage of 600 V.

For comparison, an electron emitting device in which the entire projection was constructed of the p-type diamond as shown in FIG. 3 was used to emit electrons, and the threshold voltage for a start of electron emission was 1.5 kV.

In accordance with the present invention, electrons in the n-type diamond forming the base of the projection are effectively injected into the conduction band of the diamond forming the electron emission portion and the electrons injected into the conduction band of the diamond adequately reach the surface of the electron emission portion; therefore, electrons can be efficiently emitted from the electron emitting device. Accordingly, the electron emitting devices according to the present invention are suitably applicable to electron beam application equipment with high performance, e.g., electron beam processing equipment such as the microwave oscillators, high-frequency amplifiers, and electron beam lithography apparatus.

It is apparent from the above description of the present invention that the present invention can be modified in various ways. It is noted that such modifications are not to be considered as departing from the spirit and scope of the present invention and that all improvements obvious to those skilled in the art are to be considered as included in the scope of claims which follow.

What is claimed is:

1. An electron emitting device comprising;

a substrate comprised of an n-type diamond; and a projection provided on said substrate, said projection having:

a base comprised of an n-type diamond; and an electron emission portion provided on said base and emitting electrons from a tip thereof, wherein said electron emission portion comprises a tip layer comprised of a p-type diamond, and an intermediate layer comprised of a non-doped diamond provided between said tip layer and said base, and wherein an interface between said base and said intermediate layer is exposed to a vacuum space surrounding said electron emitting device.

2. An electron emitting device according to claim 1, wherein a height of said electron emission portion, defined by a distance from the tip of said projection to the interface between said base and said electron emission portion is 100 nm or less.

3. An electron emitting device according to claim 1, wherein a height of said electron emission portion, defined by a distance from the tip of said projection to an interface between said base and said electron emission portion, is not more than a width of a space charge region formed in an area including the interface between said base and said electron emission portion.

4. An electron emitting device according to claim 1, wherein a surface of said electron emission portion is hydrogen-terminated.

* * * * *